US008327478B2

(12) United States Patent
Faridoon

(10) Patent No.: US 8,327,478 B2
(45) Date of Patent: Dec. 11, 2012

(54) FABRIC CASE

(76) Inventor: Husain S. A. Faridoon, Doha (KW)

( * ) Notice: Subject to any disclaimer, the term of this patent is extended or adjusted under 35 U.S.C. 154(b) by 302 days.

(21) Appl. No.: 12/773,134

(22) Filed: May 4, 2010

(65) Prior Publication Data

US 2011/0271448 A1 Nov. 10, 2011

(51) Int. Cl.
*A47C 27/00* (2006.01)

(52) U.S. Cl. ..... 5/423; 5/737; 5/724; 5/725; 5/726; 5/948

(58) Field of Classification Search ..... 5/737, 724, 5/725, 726, 423, 421, 652.2, 500, 502, 948
See application file for complete search history.

(56) References Cited

U.S. PATENT DOCUMENTS

| | | | | |
|---|---|---|---|---|
| 4,628,557 | A | 12/1986 | Murphy | |
| 4,914,837 | A | 4/1990 | Rieffel | |
| 5,473,783 | A * | 12/1995 | Allen | 5/652.2 |
| 5,887,304 | A | 3/1999 | von der Heyde | |
| 6,159,169 | A | 12/2000 | Lambden | |
| 6,263,530 | B1 * | 7/2001 | Feher | 5/423 |
| 6,546,576 | B1 * | 4/2003 | Lin | 5/423 |
| 6,581,225 | B1 * | 6/2003 | Imai | 5/423 |
| 6,871,365 | B2 * | 3/2005 | Flick et al. | 5/421 |
| 6,904,629 | B2 * | 6/2005 | Wu | 5/423 |
| 6,904,632 | B1 * | 6/2005 | Wu | 5/630 |
| 7,007,330 | B2 | 3/2006 | Kuiper | |
| 7,293,311 | B2 * | 11/2007 | Baker | 5/721 |
| 7,950,084 | B1 * | 5/2011 | McKay et al. | 5/423 |
| 2005/0086739 | A1 * | 4/2005 | Wu | 5/423 |
| 2005/0278863 | A1 * | 12/2005 | Bahash et al. | 5/726 |
| 2006/0080778 | A1 * | 4/2006 | Chambers | 5/652.2 |
| 2007/0136952 | A1 * | 6/2007 | Sargent | 5/726 |
| 2007/0261173 | A1 * | 11/2007 | Schlussel | 5/725 |
| 2008/0098529 | A1 * | 5/2008 | Flocard et al. | 5/652.2 |
| 2009/0308404 | A1 * | 12/2009 | Leonard et al. | 128/889 |
| 2010/0175196 | A1 * | 7/2010 | Lafleche et al. | 5/707 |
| 2010/0235992 | A1 * | 9/2010 | Bensoussan | 5/424 |

* cited by examiner

*Primary Examiner* — Robert G Santos
*Assistant Examiner* — David E Sosnowski
(74) *Attorney, Agent, or Firm* — Lowe Hauptman Ham & Berner, LLP

(57) ABSTRACT

A mattress and/or seat cushion for reducing pain and anaesthetization of parts of the human body include a stretchable fabric case made of textile threads and elastomer or rubber threads woven together to form a stretchable fabric. The case has a top layer with a top surface and a bottom surface and a bottom layer with a top or inner surface and a bottom or outer surface and the size to cover a cushion for a seat or mattress that fits on a cot or bed. The seat cushion or mattress also includes a relatively thin resilient pad disposed within the fabric case adjacent the bottom surface of the top layer and includes a number of passageways extending therethrough. In addition, a mass of cleaned sand and mountain salt is disposed within the fabric case below the resilient pad and below the bottom layer. Also included is a means for pumping air and medication into and out of the mattress which will impinge upon and pass around the body of an individual in order to wholly or partly enclose the person in a micro climate to promote healing, prevent bed sores and the like.

8 Claims, 2 Drawing Sheets

FABRIC CASE

FIELD OF THE INVENTION

This invention relates to a fabric case for a seat cushion or the like and more particularly to a medicated mattress for reducing pain, possibly thrombosis and anaesthetization of parts of the human body when an individual is confined to a bed or chair during long periods of confinement.

BACKGROUND FOR THE INVENTION

Fabric cases such as seat cushions for cars, motorcycles and aircraft as well as mattresses for home and hospital are well known and have been in use for many years. In fact, over the years there have been many developments particularly to improve the comfort and support for individuals who are confined to a bed or chair for relatively long periods of time. For example, on sitting for a long time, as for example on flights between the United States and Asia, an individual may be subjected to anaesthetization and/or pain in the legs or back and even weakness in the heart because blood flow is impeded. One approach for a person who is confined to a bed for relatively long periods, as for example in a nursing home, is disclosed in a U.S. Pat. No. Maddux, Jr. et al. (U.S. Pat. No. 3,419,920). As disclosed in the Maddux, Jr. et al. patent the mattress includes a head portion hingedly connected to a fixed central portion and a foot portion of the mattress hingedly connected to the opposite end of the central portion. In addition, to forming the mattress with hinged portions, each portion is provided with a different compression resistance, the head portion being softer than the central portion while the foot portion is softer than the head portion since it does not need to provide as much support and the central portion may be harder than either the head or foot portions since it supports the most weight thereby making the individual more comfortable.

A more recent development in mattresses is disclosed in a U.S. Pat. No. 4,057,861 of Howorth. As disclosed therein, a mattress to which conditioned air can be supplied to issue form the mattress to impinge upon and pass around the body of a person to partially enclose an individual in a microclimate to promote healing or maintain the health of the individual. A supply of conditioned air to a person can be of great assistance in the prevention of bed sores and can greatly increase the healing of bones. Further, the provision of a supply of warm air to an elderly person at home during sleeping can be of assistance in preventing hypothermia.

A further approach to a ventilating mattress is disclosed in a U.S. patent of Klearman, U.S. Pat. No. 5,493,742. As disclosed the mattress includes a mattress cover having as down-filled quilted upper portion overlaying the upper surface of the mattress such that air escaping from the ventilating air mattress inflates the quilted portion. The differential air pressure drop across the upper and lower layers of the quilted portion of the mattress pad and provides a pillowing or fluffy effect which increases the comfort for the user. An air pump with a remote control provides user adjustability of the firmness of the mattress. Alternate embodiments include a readily changeable mattress cover or sheet with quilting instead of the quilted mattress pad.

Notwithstanding the above, it is presently believed that there is a need and a potential market for an improved fabric case for use as a seat cushion or medicated mattress. There should be a commercial market for such cases as seats for cars, motorcycles, planes, ships and trains for relief of anaesthetized legs, back pain and possible avoidance of thrombosis as well as beds for the home and hospital for relief from bed sores or the like. It is presently believed that seats and mattress in accordance with the present invention reduce the likelihood of impeding blood flow to various parts of the body, can be manufactured and sold at a competitive price, are durable and are particularly effective in reducing the stress of being confined for relatively long periods of time.

BRIEF SUMMARY OF THE INVENTION

In essence the fabric case for use as a cushion or mattress includes a top layer having a top surface and a bottom surface, and a bottom layer having a top or inner layer and a bottom or outer layer. The fabric case also comprises a stretchable fabric made of textile thread and elastomer threads woven together. A relatively thin resilient pad disposed within the fabric case adjacent the bottom surface of the top layer is provided. In addition, a mass of cleaned and sieved sea sand and a mass of mountain salt are disposed within the fabric case below the thin resilient pad and above the inner surface of the bottom layer. This mass of cleaned and sieved sea sand and mountain salt has approximately 90 wgt. % sand and 10 wgt. % salt.

The invention will now be described in more detail in connection with the accompanying drawings wherein like reference numerals have been used to indicate like points.

DESCRIPTION OF THE PREFERRED EMBODIMENTS OF THE INVENTION

Figure 1:
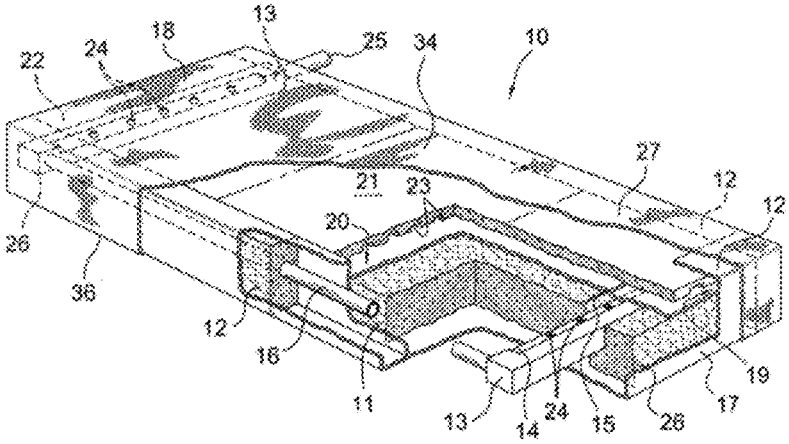
FIG. 1 Prior Art
FIG. 1 is an isomeric view of a prior art mattress.

A prior art mattress 10 comprises a base 11 in the form of a rectangular block of foamed plastic material 147 cm long, 71 cm wide and 12.5 cm thick. Along each longer edge of the base 11 is disposed a lateral member 12 in the form of a strip of foamed plastic material 15 cm by 7.5 cm in cross section. Across each end of the base 11 extends a generally L-section transpose member 26 which supports a manifold 14 in the form of a ridged generally rectangular sectional tube. The top surface of the manifold 14 is level with the top surface of the base 11 and facing the base are chanford at 14 as is the base at 15 for a purpose to be later described. Extensions of the lateral member 12 enclose end portions of the manifold 13.

Each lateral member 12 has a longitudinally extending central circular aperture which accommodates a flexible conduit 16 connecting the respective ends of the manifold 13.

The base 11, lateral members 12 and manifolds are enclosed in an air-impermeable water proof washable envelope 17 of synthetic plastic material and end flaps 18 of the material extend between the lateral members 12 above the manifolds 13 to form pockets 19. This purpose will be later described. Because the lateral members 12 are thicker than the base 11 they define a recess 20 and serve to retain overlay 21 on top of the base 11.

The overlay 21 is of an open-cell foamed plastic material, 147 cm long, 71 cm wide and 25 cm thick and over lie the base 11 between the lateral members 12. Its end portions 22 are received in the pockets 19.

In the underside of the overlay 21 are formed five equally spaced air passages 23 extending longitudinally. Each passage is in the form of a channel 3 cm wide by 1 cm deep and each end of each channel adjacent its closure over lays an aperture 24 some 2 cm in diameter in the underlying manifold. The chanford top portion 14 of the manifold 13 in which the apertures are provided i.e. that portion adjacent to base 11 places the aperture 24 slightly below the level on the top of the base 11. This minimizes the possibility of the person on the mattress 10 accidentally closing one or more of the aperture 24 by applying localized pressure to the over lay 21.

One of the manifolds 13 has a spigot 25 extending out of the envelope for connection to a supply of air which is heated or cooled and is filtered to remove bacteria therefrom. The air supply required is some 0.8-1.3 cm./min. Preferably about 1.6 cm/min. A light cover 27, for example of knitted fabric can be fitted to the whole mattress.

Figure 2:
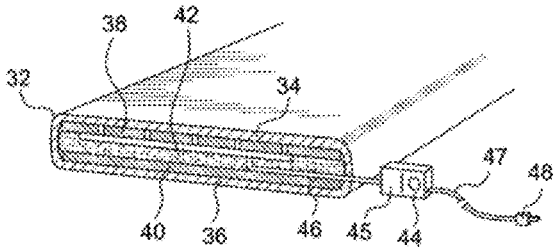
FIG. 2 is schematic illustration of a fabric case for use in a cushion or mattress in accordance with the present invention.
Figure 3:
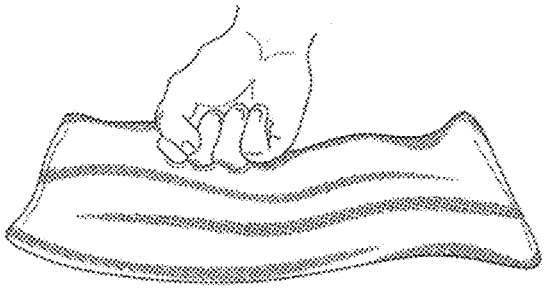
FIG. 3 is a schematic illustration of a person's fists pressed against a relatively small prototype of a fabric case in accordance with the present invention.
Figure 4:
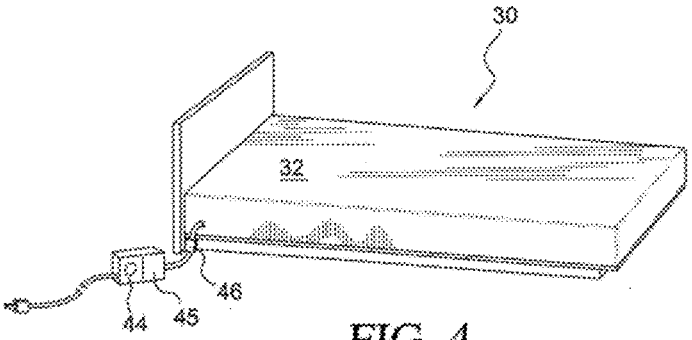
FIG. 4 is a schematic illustration of a medicated mattress in accordance with a preferred embodiment of the invention.

A fabric case or mattress will now be described in connection with FIGS. 2, 3, and 4. As shown in FIG. 2, a cushion or mattress 30 includes an outer cover 32 having a top layer with a top surface 34 and a bottom surface as well as a bottom layer 36 having an inner or top surface and an outer or bottom surface. This fabric case is made of a stretchable fabric made of textile threads and elastomer or rubber threads woven together. The fabric case may also includes a relatively thin resilient pad 38 disposed within the fabric case adjacent the bottom surface of the top layer. The structure may also include a second resilient pad 40 adjacent to the top or inner surface of the bottom layer. Intermediate of the two pads is a relatively thick layer 42 of the cleaned and sieved sea sand and a mass of mountain salt and wherein the mountain salt is present in an amount of about 10 wgt. % of the amount of sea sand and is intimately mixed therewith. Means such as an air pump 44 communicates from the outside of the fabric case to a recessed area in the sand salt mix and is constructed and arranged to pump cleaned and possibly warmed air into that area below the relatively thin resilient pad having a plurality of passages there through so that air is pumped into and flows through the top surface of the fabric case to supply air which is heated or cooled by heating element 45 and filtered to remove bacteria, as shown in the prior art example. The air pump is also connected to a medication dispenser 46 so that the air that is pumped carries medication into an inner chamber and that flows upward through the top layer. It is also contemplated that a textile mattress cover will encase the mattress. The air pump 44 and heating element 45 are connected by an electrical cord 47 and plug 48 to an electric outlet not shown.

The passages can extend across the mattress as well as longitudinally thereof, although it must always be insured that air is supplied to substantially the entire area of the upper layer. Supply can be from one of both ends. The base can be inflatable or can be a flexible envelope with beads or the like for example silicone beads.

The dimensions of a mattress in accordance with the preferred embodiment of the invention are essentially the same as those set forth for the prior art. However, the layer of sand should have a thickness of at least 5 cm while the flexible relatively thin resilient pad should have a minimal thickness as for example about 2 cm.

While the invention has been described in connection with its preferred embodiments, it should be recognized that changes and modifications may be made therein without departing from the scope of appended claims.

What is claimed is:

1. A fabric case for use as a cushion or mattress, said fabric case comprising:

a top layer having a top surface and a bottom surface and a bottom layer having an inner top surface and an outer bottom surface;

said fabric case comprising a stretchable fabric made of textile thread and elastomer thread woven together;

a thin resilient pad disposed within said fabric case adjacent said bottom surface of said top layer; and a mass of cleaned and sieved sea sand and a mass of mountain salt disposed within said fabric case below said resilient pad and above said inner surface of said bottom layer and wherein the amount of said mountain salt is about 10 wgt. % of the amount of said sea sand.

2. A fabric case for use as a cushion or mattress according to claim 1 that includes means for pumping air into said fabric case and out of said top layer.

3. A fabric case for use as a cushion or mattress according to claim 2 which includes means for heating the air pumped into said fabric case.

4. A fabric case for use as a cushion or mattress according to claim 3 which includes means for dispensing medicine within said fabric case.

5. A fabric case for use as a cushion or mattress according to claim 2 which includes means for dispensing medicine into and out of said fabric case.

6. A medicated mattress for reducing pain, or anaesthetized portions of the human body, said mattress comprising;

a stretchable fabric case made of textile threads and elastomer threads woven together and having a top layer with a top surface and a bottom surface and a bottom layer with a top inner surface and a bottom outer surface and said stretchable fabric case sized to cover a cot or bed;

a thin resilient pad disposed within said fabric case adjacent said bottom surface of said top layer and including a number of passageways extending through said resilient pad;

a mass of cleaned sand and a mass of mountain salt disposed within said fabric case below said resilient pad and wherein the amount of mountain salt is about 10 wgt. % of the amount of said sand;

means for pumping air into said fabric case and through said passages in said resilient pad; and means for heating the air pumped into said fabric case.

7. A medicated mattress for reducing pain, thrombosis or anaesthetization of the human body according to claim 6 which includes means for dispensing medication into said heated air.

8. A medicated mattress for reducing pain and anesthetization of various parts of the human body, said mattress consisting of:

a stretchable fabric case made of textile threads and elastomer threads woven together and having a top layer with a top surface and a bottom surface and a bottom layer with a top inner surface and a bottom outer surface and said stretchable fabric case sized to cover a cot or bed;

a thin resilient pad disposed within said fabric case adjacent said bottom surface of said top layer and including a number of passageways extending through said resilient pad;

a mass of cleaned sand and a mass of mountain salt disposed within said fabric case below said resilient pad and wherein the amount of mountain salt is about 10 wgt. % of the amount of said sand;

means for pumping air into said fabric case and through said passages in said resilient pad; and means for heating the air pumped into said fabric case.

* * * * *